US011685585B2

(12) United States Patent
Shi

(10) Patent No.: US 11,685,585 B2
(45) Date of Patent: Jun. 27, 2023

(54) COMBINED STRAW AND BOTTLE INCLUDING SAME

(71) Applicant: TAIZHOU GUANGHANG E-COMMERCE CO., LTD., Taizhou (CN)

(72) Inventor: Wenhui Shi, Taizhou (CN)

(73) Assignee: TAIZHOU GUANGHANG E-COMMERCE CO., LTD., Taizhou (CN)

( * ) Notice: Subject to any disclaimer, the term of this patent is extended or adjusted under 35 U.S.C. 154(b) by 0 days.

(21) Appl. No.: 17/400,144

(22) Filed: Aug. 12, 2021

(65) Prior Publication Data

US 2023/0034663 A1 Feb. 2, 2023

(30) Foreign Application Priority Data

Aug. 2, 2021 (CN) ..... 202121788816.7

(51) Int. Cl.
*B65D 77/28* (2006.01)
*B65D 47/08* (2006.01)

(52) U.S. Cl.
CPC ..... *B65D 77/283* (2013.01); *B65D 47/0828* (2013.01)

(58) Field of Classification Search
CPC ..... B65D 77/283; B65D 47/0828
See application file for complete search history.

(56) References Cited

U.S. PATENT DOCUMENTS 2,052,307 A * 8/1936 Kennedy ..... B65D 77/283 215/229
3,211,379 A * 10/1965 Burton ..... B65D 77/283 215/388
3,303,984 A * 2/1967 Jurena ..... B65D 77/283 229/103.1
3,349,955 A * 10/1967 Cornelius ..... B65D 17/506 220/270
4,228,913 A * 10/1980 Mack ..... B65D 77/283 220/710
4,448,316 A * 5/1984 Hiroshige ..... B65D 77/283 215/229
5,501,348 A * 3/1996 Takeuchi ..... B65D 47/0828 220/827
6,196,413 B1 * 3/2001 Tung ..... B65D 47/0885 220/717

(Continued)

FOREIGN PATENT DOCUMENTS

KR 20130034381 A * 4/2013 ..... B65D 77/283

*Primary Examiner* — Donnell A Long

(57) ABSTRACT

A straw bottle includes a straw bottle body and a cover seat, wherein the cover seat is provided with an opening; an end of a cover is hinged with the cover seat, and another end of the cover is connected with the cover seat in a snap-fit manner to open or close the opening; a straw detachably connected with the cover seat, the straw includes a rigid part and a resilient part arranged at a bottom of the rigid part; when the cover is locked with the cover seat, the cover pushes the straw to make the resilient part be in the pressed and bent state, and the straw retracts back into the opening; and when the cover is unlocked with the cover seat, the resilient part is restored by a resilient force, so as to push the straw out of the opening and the straw pushes the cover up.

11 Claims, 6 Drawing Sheets

(56) References Cited

U.S. PATENT DOCUMENTS

| | | | | |
|---|---|---|---|---|
| 6,230,913 | B1 * | 5/2001 | Cornell | B65D 77/283 215/40 |
| 7,516,869 | B1 * | 4/2009 | Hajianpour | B65D 77/283 215/388 |
| 2002/0121495 | A1 * | 9/2002 | Kozlov | B65D 77/283 215/229 |

* cited by examiner

COMBINED STRAW AND BOTTLE INCLUDING SAME

CROSS-REFERENCE TO RELATED APPLICATIONS

This application is based upon and claims priority to Chinese Patent Application No. 202121788816.7, filed on Aug. 2, 2021, the entire content of which is incorporated herein by reference.

TECHNICAL FIELD

The present disclosure relates to a combined straw and bottle including same.

BACKGROUND

An existing straw bottle mainly includes four parts: a bottle body, a lower cover seat, an upper cover, and a straw. The lower cover seat and the upper cover are hinged to each other at one side by a hinge structure, and are locked and unlocked by a snap-fit component at another side. The lower cover seat is provided with a straw hole. The straw is inserted into the straw hole to be fixed to the lower cover seat. A user may sip water in the bottle through the straw. The bottle may also be provided with a pressure balancing hole to provide an access for air to enter the bottle body when the user drinks water using the bottle, so as to balance the pressure inside and outside the bottle. However, since the straw is inserted into the straw hole and fixed to the lower cover seat, the straw cannot be detached for cleaning. In addition, the arrangement of the pressure balancing hole may easily cause water leakage.

SUMMARY

The present disclosure provides a straw bottle, which can effectively solve the above-mentioned problems.

The present invention provides a straw bottle, including: a straw bottle body;

a cover seat matched with the straw bottle body, wherein the cover seat is provided with an opening;

a first end of a cover is hinged with the cover seat, and a second end of the cover is connected with the cover seat in a snap-fit manner to open or close the opening;

a straw detachably connected with the cover seat, the straw includes a rigid part and a resilient part arranged at a bottom of the rigid part; when the cover is locked with the cover seat, the cover pushes the straw to make the resilient part be in the pressed and bent state, and the straw retracts back into the opening; and when the cover is unlocked with the cover seat, the resilient part is restored by a resilient force, so as to push the straw out of the opening and the straw pushes the cover up.

The advantages of the present disclosure are as follows. First, since the straw and the cover seat in the present disclosure are arranged detachably, it is easy to take out the straw for cleaning. Second, since the straw and the cover seat in the present disclosure are arranged detachably, the straw and the cover seat are not tightly fitted, and there is a gap formed between the straw and the cover seat. The gap may be used as the pressure balancing hole without the need to set pressure balancing hole on the cover seat. Hence, there is no need to worry about water leakage. Third, when the straw fails, the user may need to replace the whole cover seat for the conventional straw bottle, while in the present disclosure, since the straw and the cover seat are connected in a detachable manner, when the straw fails, the user may only need to replace the straw, which is cost-saving. Fourth, in the present disclosure, the straw has a resilient part, when the cover is unlocked with the cover seat, the resilient part is restored by a resilient force, so that the straw is pushed out of the opening and at the same time the cover is pushed up, which is user friendly.

BRIEF DESCRIPTION OF THE DRAWINGS

In order to illustrate the technical solutions used in the implementations of the present disclosure clearly, the drawings that are related to the illustration of the implementations will be briefly introduced below. It should be understood that the following drawings only show parts of the embodiments of the present disclosure. Therefore, the drawings should not be regarded as a limit to the scope of the present disclosure. For those of ordinary skill in the art, other related drawings can be derived from these drawings without creative effort.

Figure 1:
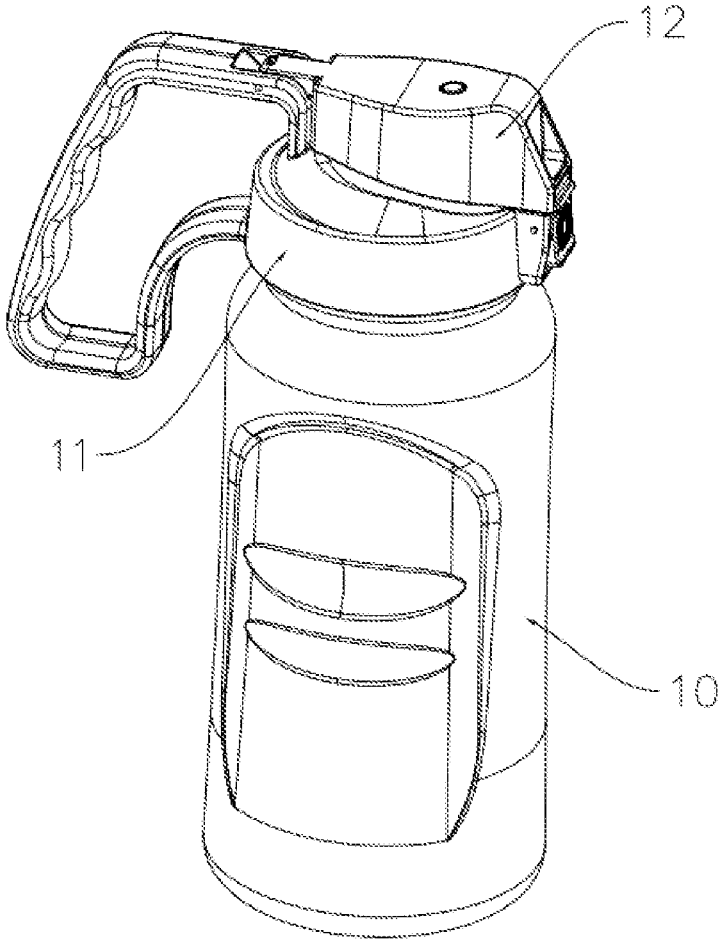
FIG. 1 is a structural schematic diagram of an embodiment of the present disclosure.

The reference numerals are listed below:

10. straw bottle body;

11. cover seat;

111. opening; 112. engaging element; 113. tubular opening;

12. cover;

121. resilient silicone pad; 122. spring; 123. engaging element counterpart;

13. straws;

131. rigid part; 132. resilient part; 133. straw tip; 134. supporting pad; 1320. notch; 1321. annular rib; 1322. reinforcing rib; 1323. annular groove; 1330. annular protrusion.

DETAILED DESCRIPTION OF THE EMBODIMENTS

In order to make the objectives, technical solutions, and advantages of the embodiments of the present disclosure clearer, the technical solutions of the embodiments of the present disclosure will be described clearly and completely below with reference to the drawings of the embodiments of the present disclosure. Obviously, the described embodiments are parts of, but not all of, the embodiments of the present disclosure. Based on the embodiments of the present disclosure, all other embodiments derived by those of ordinary skills in the art without creative effort fall within the scope of protection of the present disclosure. Accordingly, the following detailed description of the embodiments of the present disclosure shown in the drawings is not intended to limit the scope of protection of the present disclosure, but merely to represent selected embodiments of the present disclosure. Based on the embodiments of the present disclosure, all other embodiments derived by those of ordinary skills in the art without creative effort fall within the scope of protection of the present disclosure.

In the description of the present disclosure, the terms "first", "second" are used only for descriptive purposes and cannot be understood as indicating or implying relative importance or implying the number of indicated technical features. Thus, a characteristic that is referred to by "first" and "second" may include, expressly or implicitly, one or more of the characteristics. Also, in the description of the present disclosure, the phrase "a plurality of" means two or more, unless otherwise specified.

Figure 2:
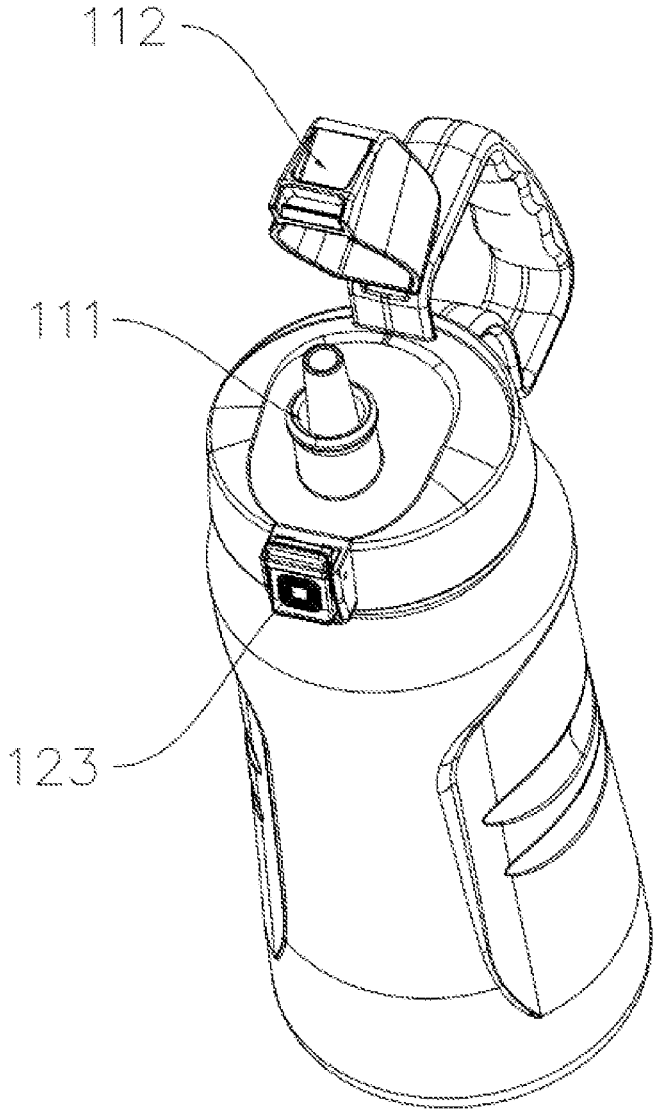
FIG. 2 is a state reference diagram of an embodiment of the present disclosure with a cover open.
Figure 3:
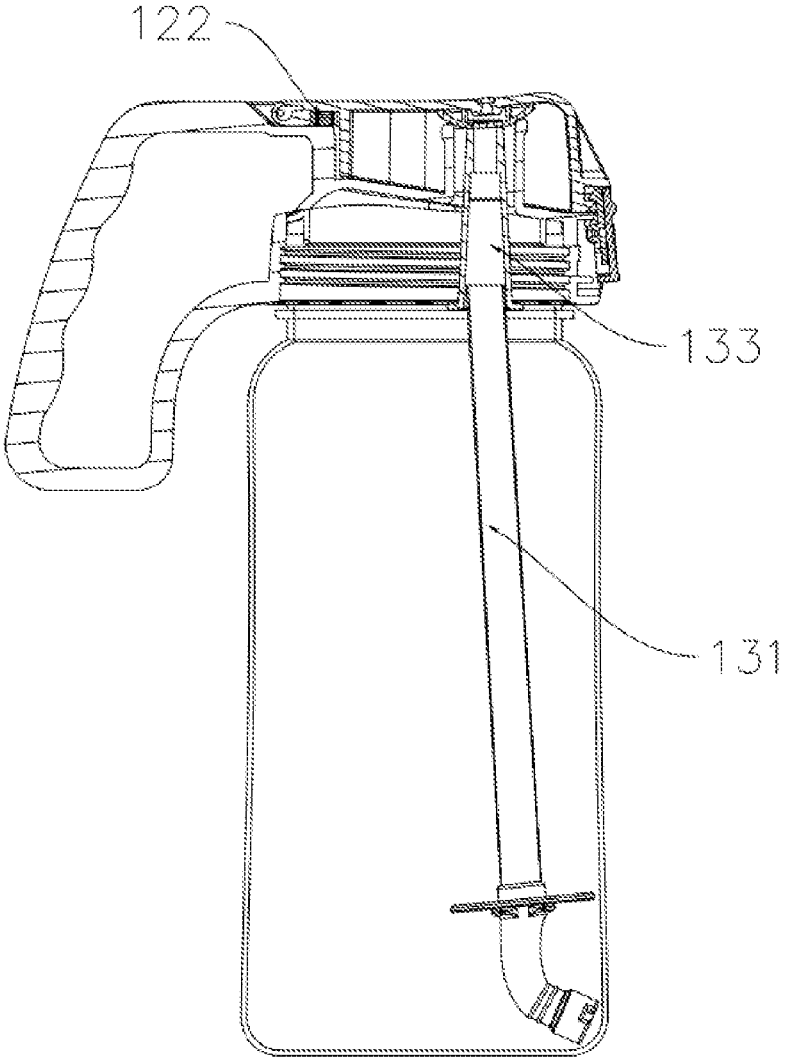
FIG. 3 is a cross-sectional view of an embodiment of the present disclosure with the cover closed.
Figure 4:
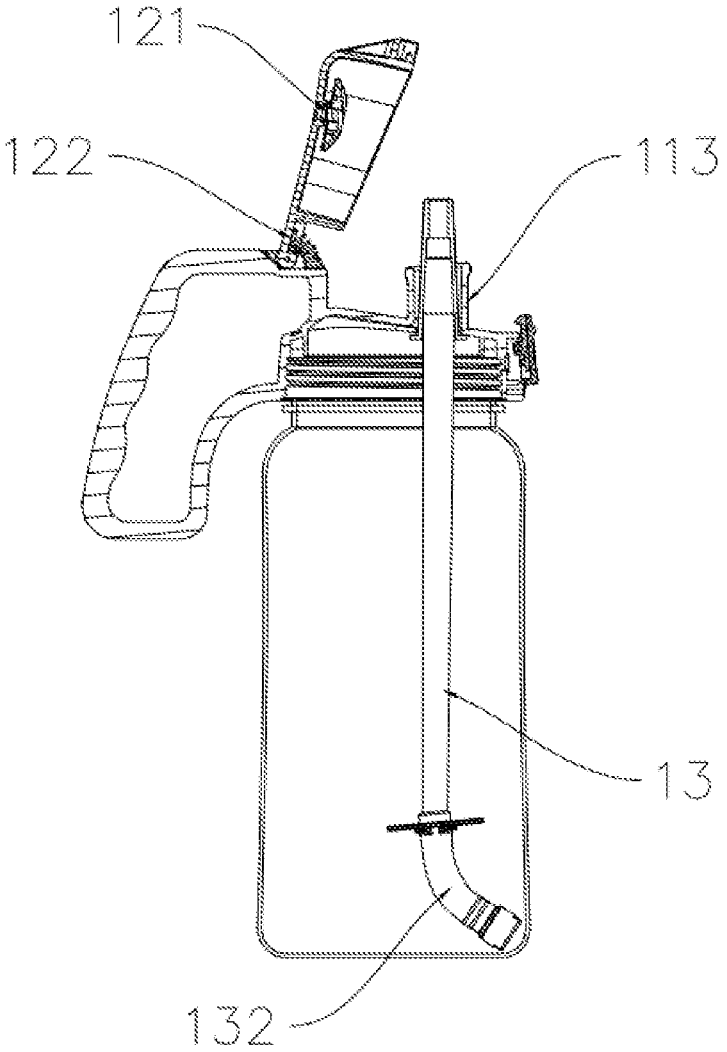
FIG. 4 is a cross-sectional view of an embodiment of the present disclosure with the cover open.
Figure 5:
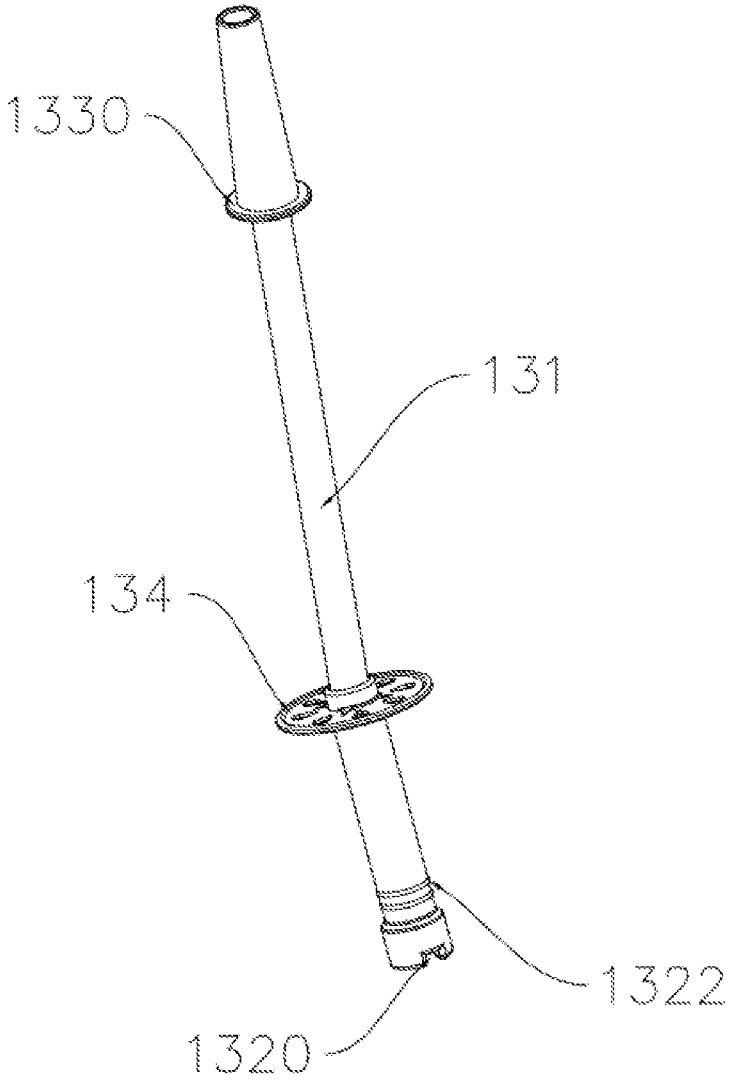
FIG. 5 is a structural schematic diagram of a straw of an embodiment of the present disclosure.
Figure 6:
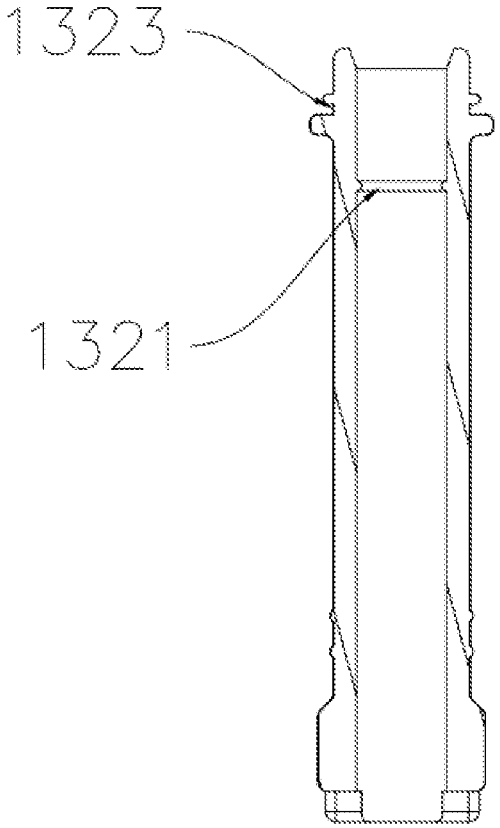
FIG. 6 is a cross-sectional view of a resilient part according to an embodiment of the present disclosure.

Referring to FIGS. 1-6, the present embodiment of the disclosure provides a straw bottle, including:

a straw bottle body 10;

a cover seat 11 matched with the straw bottle body 10, wherein the cover seat 11 is provided with an opening 111;

a first end of a cover 12 is hinged with the cover seat 11, and a second end of the cover 12 is connected with the cover seat 11 in a snap-fit manner to open or close the opening 111;

a straw 13 detachably connected with the cover seat 11, the straw 13 includes a rigid part 131 and a resilient part 132 arranged at a bottom of the rigid part 131; when the cover 12 is locked with the cover seat 11, the cover 12 pushes the straw 13 to make the resilient part 132 be in the pressed and bent state, and the straw 13 retracts back into the opening 111; and when the cover 12 is unlocked with the cover seat 11, the resilient part 132 is restored by a resilient force, so as to push the straw 13 out of the opening 111 and the straw 13 pushes the cover 12 up.

The cover seat 11 and the straw bottle body 10 may be engaged with each other in a threaded manner or a snap-fit manner. In this embodiment, the cover seat 11 and the straw bottle body 10 may be engaged with each other in a threaded manner.

Since the straw 13 and the cover seat 11 in the present disclosure are arranged detachably, it is easy to take out the straw 13 for cleaning. Second, since the straw 13 and the cover seat 11 in the present disclosure are arranged detachably, the straw 13 and the cover seat 11 are not tightly fitted, and there is a gap formed between the straw 13 and the cover seat 11. The gap may be used as the pressure balancing hole without the need to set pressure balancing hole on the cover seat 11. Hence, there is no need to worry about water leakage. Third, when the straw of the conventional straw bottle fails, the user may need to replace the whole cover seat, while in the present disclosure, since the straw 13 and the cover seat 11 are connected in a detachable manner, when the straw 13 fails, the user may only need to replace the straw 13, which is cost-saving. For example, when the rigid part 131 is broken, or the resilient part 132 loses resilience, the rigid part 131 or the resilient part 132 may be replaced directly. Fourth, in the present disclosure, the straw 13 has a resilient part 132, when the cover 11 is unlocked with the cover seat 13, the resilient part 132 is restored by a resilient force, so that the straw 13 is pushed out of the opening 111 and at the same time the cover 11 is pushed up, which is user friendly.

As a further improvement, in other embodiments, the cover seat 11 has a part extending upward to form a tubular opening 113. When the cover 12 is locked with the cover seat 11, the cover 12 presses the straw 13 to make the resilient part 132 be in the pressed and bent state, and the straw 13 retracts back into the tubular opening 113. It can be understood that since the top part of the straw 13 is able to move in the tubular opening 113, when the cover 12 is unlocked with the cover seat 11, the resilient part 132 is restored by the resilient force, which makes it easier to push the straw 13 out of the tubular opening 113.

As a further improvement, in other embodiments, the distance from the bottom of the tubular opening 113 to the bottom of the straw bottle body 10 is defined as L, and the radius of the bottom of the straw bottle body 10 is defined as R. The length of the rigid part 131 is about same as the length L, and the length of the resilient part 132 is about same as the radius R. It can be understood that the perfect match of the lengths of the rigid part 131 and the resilient part 132 may make it easier to push the straw 13 out of the opening 111. If the rigid part 131 is too long, the straw may not be sufficiently hold within the straw bottle body 10. If the rigid part 131 is too short, the resilient force may not be large enough to push the straw out.

As a further improvement, in other embodiments, an end of the resilient part 132 away from the rigid part 131 is provided with a notch 1320. It can be understood that the notch 1320 may avoid the resilient part 132 to suck on the bottom or side wall of the straw bottle body 10 when a user drinks water from the bottle. As a further improvement, in other embodiments, an outer side of an end of the resilient part 132 close to the rigid part 131 is provided with a supporting pad 134. Since the resilient part 132 is constantly pressed and bent, the resilient part 132 is easy to adhere to the straw bottle body 10 when they are in contact with each other, thereby negatively impacting the restoration of the resilient part 132. The supporting pad 134 arranged on the outer side of the resilient part 132 ensures that the supporting pad 134 come into contact with the straw bottle body 10 when the straw is pressed down, so as to support the resilient part 132. Hence, there is no large-area contact between the resilient part 132 and the straw bottle body 10, and adhesion is avoided. An annular groove 1323 is provided on the outer side of one end of the resilient part 132 close to the rigid part 131, and the supporting pad 134 is installed in the annular groove 1323 to fix the supporting pad 134. As a further improvement, in other embodiments, the end of the resilient part 132 away from the rigid part 131 is further provided with a reinforcing rib 1322 to prevent the resilient part 132 from being deformed under frequent press. The inner wall of an end of the resilient part 132 close to the rigid part 131 is further provided with an annular rib 1321, which is used to enhance the structural strength of the resilient part 132 and limit the installation position of the rigid part 131.

As a further improvement, in other embodiments, the included angle between the resilient part 132 and the rigid part 131 is greater than or equal to 170° and less than 180°. In one of the embodiments, the included angle between the resilient part 132 and the rigid tube 131 is about 175°. By configuring the resilient part 132 and the rigid part 131 with the above included angle, it is easier for the resilient part 132 to be pressed and bent when the cover 12 is locked with the cover seat 11.

As a further improvement, in other embodiments, the straw 13 further includes a straw tip 133 disposed on the top of the rigid part 131, and the straw tip 133 has a hollow truncated cone-shaped structure. Further, the bottom of the straw tip 133 close to the rigid part 131 is provided with an annular protrusion 1330. The annular protrusion 1330 is engaged with the bottom of the tubular opening 113.

As a further improvement, in other embodiments, the cover 12 further includes an resilient silicone pad 121 for sealing the opening 111. The resilient silicone pad 121 may be fixed to the cover 12 in a snap-fit manner or other manners.

As a further improvement, in other embodiments, the cover 12 further includes a spring 122. The spring 122 is provided a position of the hinge connection between the cover 12 and the cover seat 11. When the cover 12 is unlocked with the cover seat 11, the cover 12 is pushed up. It can be understood that by configuring the resilient part 132 and the spring 122, it can be ensured that when the resilient part 132 or the spring 122 fails, the cover 12 may still be open by the alternative structure, which is user friendly.

As a further improvement, in other embodiments, the cover seat 11 is provided with an engaging element 112, and the cover 12 is provided with an engaging element counterpart 123 matched with the engaging element 112. The engaging element 112 and engaging element counterpart 123 work together to open or close the cover 12.

The described embodiments are only the alternate embodiments of the present disclosure, which do not limit the concept and scope of the present disclosure. For those of ordinary skill in the art, various modifications and changes may be made. Within the spirit and principle of the present disclosure, any modifications, equivalent substitutions, and improvements made to the technical solution of the present disclosure falls within the scope of the present disclosure.

What is claimed is:

1. A straw bottle having a combined straw, comprising:

a straw bottle body;

a cover seat matched with the straw bottle body, wherein the cover seat is provided with an opening;

a cover, wherein a first end of the cover is hinged with the cover seat, and a second end of the cover is connected with the cover seat in a snap-fit manner to open or close the opening;

a straw detachably connected with the cover seat, the straw comprising a rigid part and a resilient part arranged at a bottom of the rigid part; when the cover is locked with the cover seat, the cover pushes the straw to make the resilient part be in a pressed and bent state, and the straw retracts back into the opening; and when the cover is unlocked with the cover seat, the resilient part is restored by a resilient force, so as to push the straw out of the opening and the straw pushes the cover up;

wherein an end of the resilient part away from the rigid part is provided with a notch, an outer side of an end of the resilient part close to the rigid part is provided with a supporting pad.

2. The straw bottle having the combined straw according to claim 1, wherein the cover seat has a part extending upward to form a tubular opening, when the cover is locked with the cover seat, the cover presses the straw to make the resilient part be in the pressed and bent state, and the straw retracts back into the tubular opening.

3. The straw bottle having the combined straw according to claim 2, wherein a distance from a bottom of the tubular opening to a bottom of the straw bottle body is defined as L, and a radius of the bottom of the straw bottle body is defined as R, a length of the rigid part is about same as the distance L, and a length of the resilient part is about same as the radius R.

4. The straw bottle having the combined straw according to claim 2, wherein the straw comprises a straw tip disposed on a top of the rigid part, and the straw tip has a hollow truncated cone-shaped structure.

5. The straw bottle having the combined straw according to claim 4, wherein a bottom of the straw tip close to the rigid part is provided with an annular protrusion, the annular protrusion is engaged with a bottom of the tubular opening.

6. The straw bottle having the combined straw according to claim 1, wherein an included angle between the resilient part and the rigid part is greater than or equal to 170° and less than 180°.

7. The straw bottle having the combined straw according to claim 1, wherein the cover comprises an resilient silicone pad for sealing the opening.

8. The straw bottle having the combined straw according to claim 1, wherein the cover comprises a spring, the spring is provided a position of a hinge connection between the cover and the cover seat, when the cover is unlocked with the cover seat, the cover is pushed up.

9. A combined straw, comprising:

a rigid part and a resilient part arranged at a bottom of the rigid part;

a straw tip disposed on a top of the rigid part, wherein the straw tip has a hollow truncated cone-shaped structure, and a bottom of the straw tip close to the rigid part is provided with an annular protrusion;

a notch provided on an end of the resilient part away from the rigid part; and an outer side of an end of the resilient part close to the rigid part is provided with a supporting pad.

10. The combined straw according to claim 9, wherein a distance from an opening of a bottle to a bottom of the bottle is defined as L, and a radius of the bottom of the bottle is defined as R, a length of the rigid part is about same as the length L, and a length of the resilient part is about same as the radius R.

11. The combined straw according to claim 10, wherein an included angle between the resilient part and the rigid part is greater than or equal to 170° and less than 180°.

* * * * *